United States Patent [19]

Weststrom

[11] 3,939,587

[45] Feb. 24, 1976

[54] PAGE-TURNER FOR BOOKS AND THE LIKE

[76] Inventor: Jan Hakan Weststrom, P-antskogsvagen 5, 140 22 Upplands Balinge, Sweden

[22] Filed: Feb. 4, 1974

[21] Appl. No.: 439,280

[30] Foreign Application Priority Data

Feb. 8, 1973 Sweden ..... 73017055

[52] U.S. Cl. ..... 40/104 A

[51] Int. Cl.[2] ..... G09F 11/00

[58] Field of Search ..... 40/104 A, 52 R, 35; 84/486, 487

[56] References Cited

UNITED STATES PATENTS

| | | | |
|---|---|---|---|
| 2,494,453 | 1/1950 | Reck | 40/104 A |
| 2,755,580 | 7/1956 | Justice | 40/104 A |
| 3,800,453 | 4/1974 | Kroes | 40/104 A |

*Primary Examiner*—John H. Wolff

*Attorney, Agent, or Firm*—Pierce, Scheffler & Parker

[57] ABSTRACT

A page-turner for books contains a page-turning roller which can be moved from one side of the open book to the other, and which can also be rotated in the desired direction. The unturned pages of the book are kept in position by means of two page retainers.

12 Claims, 10 Drawing Figures

PAGE-TURNER FOR BOOKS AND THE LIKE

The present invention relates to a page-turner for a publication, such as a book or a magazine, the covers of which are clamped on a support arranged on a frame, the pages being turned by a page-turning roller from one side of the open book to the other.

Those page-turners of the type mentioned which are considered most suitable for their purpose are unsatisfactory in that, for example, the pages cannot be turned both forwards and backwards. It has also been difficult to keep the sides of the book quite flat and thus easily read.

The present invention primarily eliminates these drawbacks with page-turners, since the page-turning roller can be rotated in one direction or the other and can be moved from one side of the support to the other, while pressing down the pages of the book not being turned with the help of two page retainers arranged in connection with the page-turning roller.

One embodiment of the invention will be described in detail in the following with reference to the accompanying drawings in which.

Figure 6:
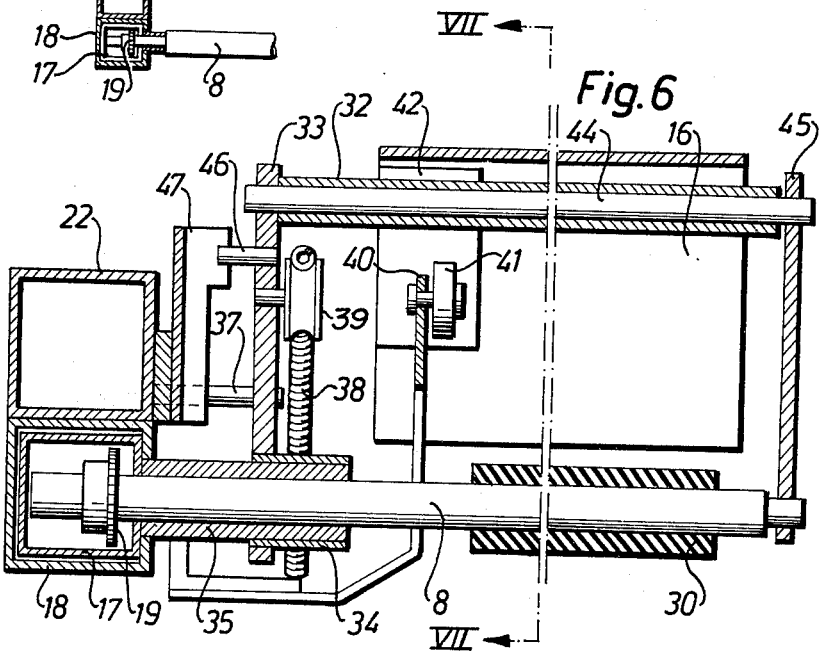
Figure 7:
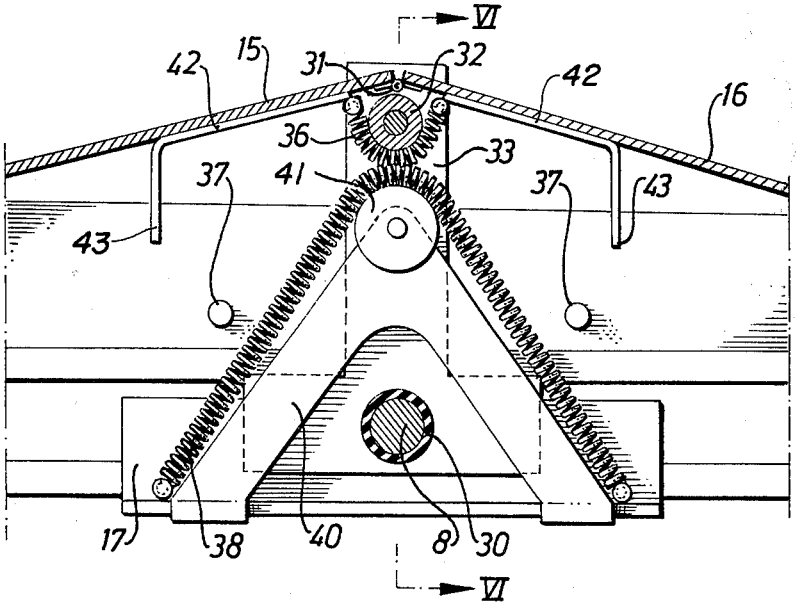
Figure 8:
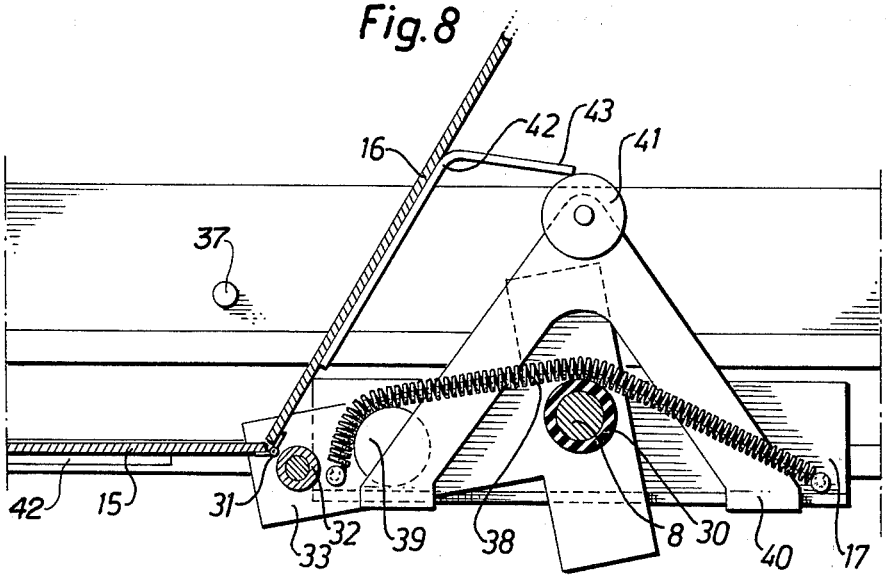
Figure 9:
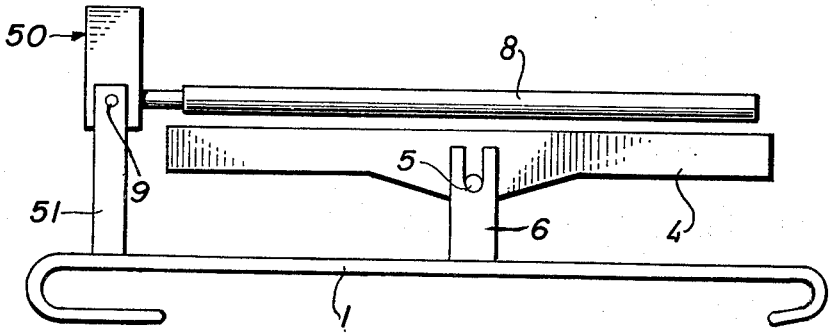
Figure 10:
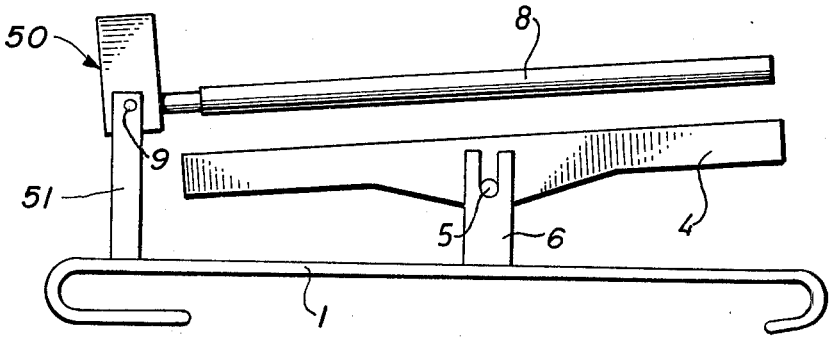

FIG. 6 is an enlarged partial longitudinal sectional view through the page-turning roller and page retainer arrangement and its guide and drive means illustrating the details at the two ends of said arrangement, the view being taken when said arrangement is in a neutral position and perpendicularly to said guide and drive means as indicated by lines VI—VI in FIG. 7, springs for the page retainers being omitted for the sake of clarity;

FIG. 7 is an enlarged cross sectional view through the page-turning roller and page retainer arrangement taken along lines VII—VII in FIG. 6, the view also illustrating how the springs for the page retainers are arranged;

FIG. 8 is a cross sectional view through the page-turning roller and page retainer arrangement of FIGS. 6 and 7 when displaced to the right into a position for turning pages from the right-hand side of an open book placed in the page-turner; and FIGS. 9 and 10, finally, are very schematic side views of the page-turner according to the invention, in which the page-turning roller and page retainer arrangement is represented by the page-turning roller and which illustrate how the page-turning roller and page retainer arrangement and the support are pivotable about horizontal axes so as to compensate for varying thickness when a book is read.

The page-turner according to the invention is intended to be of help to handicapped people in order to turn the pages in books and magazines. It is not well suited for use with larger papers, such as daily newspapers. The page-turner is operated by a switch which can be used even by extremely handicapped people.

Figure 1:
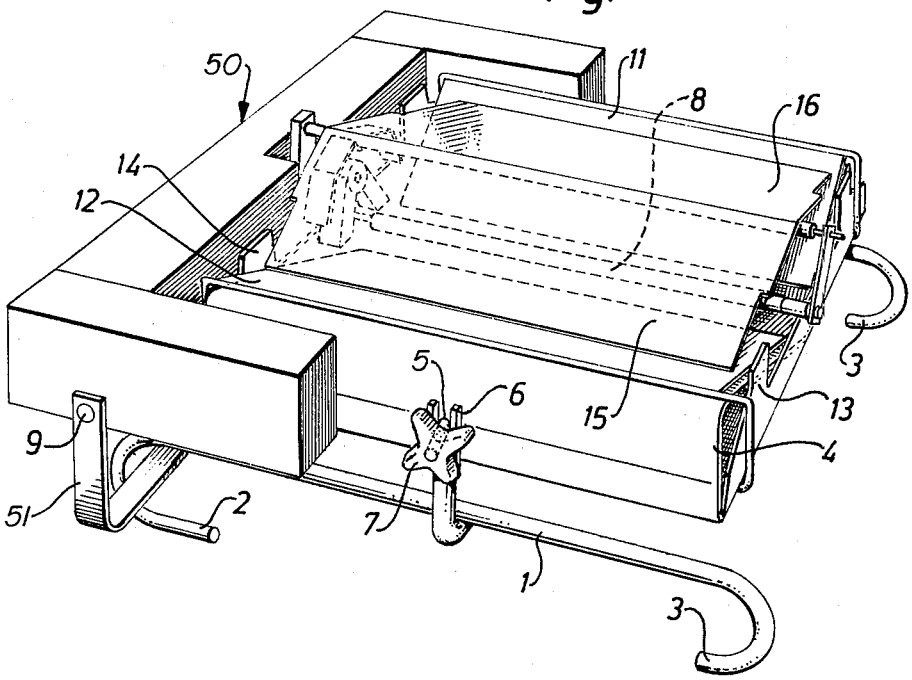
FIG. 1 is a perspective view of a pageturner according to the invention seen from the side, the page-turner comprising a frame, a support and a page-turning roller and page retainer arrangement arranged in a pivotable guide and drive means.
Figure 2:
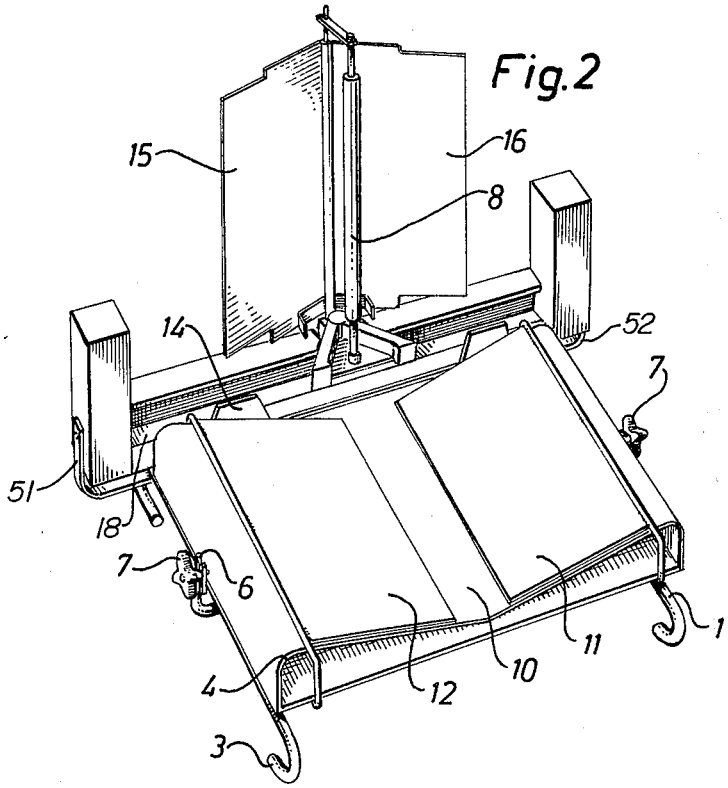
FIG. 2 is a perspective view of the pageturner of FIG. 1 seen from the front with the page-turning roller and page retainer arrangement in a raised position, a lower support piece of the support being omitted in order to better show the design of the book support.

Referring now to FIGS. 1 and 2, the pageturner comprises a frame 1 of bent tubing. On the under side of the frame the tubing is bent to form feet 2, 3 so that the page-turner can be placed on a reading table. The feet 2, 3 are bent to form hooks so that the page-turner can be hung on the edge of a reading table, for example if the table is inclined for reading in bed.

On the frame 1 is a support 4 for a book or magazine to be read with the help of the page-turner. The support 4 is pivotable with respect to the frame 1, about a horizontal axis by means of journalled shafts 5 protruding from the support 4 on either side thereof. As is indicated in FIGS. 1 and 2, the protruding ends of shafts 5 are supported in U-shaped brackets 6, open at the top and projecting from the frame 4. The ends of shafts 5 are threaded to fit threadings in knobs 7 to lock the support 4 against the brackets 6 in a desired height position. The horizontal axis passes through the centre of gravity of the support 4 at right angles to a page-turning roller 8 with which the pages shall be turned from one side to the other in the book.

The page-turning roller 8 is rotatably and displaceably arranged in a guide and drive means 50 extending along the upper edge of the support, as will be more fully described later on. The guide and drive means 50 is pivotable about a horizontal axis, parallel to the horizontal axis of the support 4, by means of pivots 9 arranged in either side of the guide means above the book. The pivots 9 are arranged in brackets 51, 52 projecting from the frame 1. Thus, the page-turning roller 8 can be swung up from the support 4 about the horizontal axis, as shown in FIG. 2. When the knobs 7 have been loosened, the basic distance between the page-turning roller 8 and the support 4 can be altered to suit the thickness of the book to be read. The thicker the books to be read with the help of the page-turner, the more the support 4 must be lowered with respect to the frame 1, that is lowered in the U-shaped brackets 6.

During the reading of the book the thickness of the pages not yet turned decreases and the thickness of the pages already turned increases. Thus, the page-turning roller 8 will meet various thickness during page-turning. This various thickness is automatically compensated for due to the fact that both the page-turning roller 8 and the support 4 are pivotable about separate horizontal axes. This ability of compensation is schematically illustrated in FIGS. 9 and 10.

The central part 10 of the support 4, located beneath the page-turning roller 8 is curved slightly downwards. This is in order to facilitate turning the pages. In order to keep a book in position on the support 4, two book retainers 11, 12 are provided on the support 4. The book retainers 11, 12 are pivotably arranged at the side edges of the support 4. By means of springs, not shown in th drawings, said retainers 11, 12 are pressed down against the support 4 to hold the covers of the book placed on the support 4.

Furthermore, the upper and lower edges of the support 4 are provided with protruding edge pieces 13 and 14. The lower support piece 13 provides an edge against which the lower edge of a book placed on the support 4 can rest when the page-turner is suspended in a vertical position. The upper support piece 14 guides the page-turning roller 8 to a certain extent during its lateral displacement.

The page-turning arrangement of the page-turner comprises the page-turning roller 8 and transparent page retainers 15, 16 arranged in conjunction therewith and preferably made of plexiglass, as well as drive and guide means for the page retainers, which will be described later on in connection with FIGS. 6–8. As shown in FIG. 2, the complete page-turning arrangement can be raised like a lid with respect to the frame 1 and support 4 so that a book can be easily inserted in the page-turner or removed.

Figure 3:
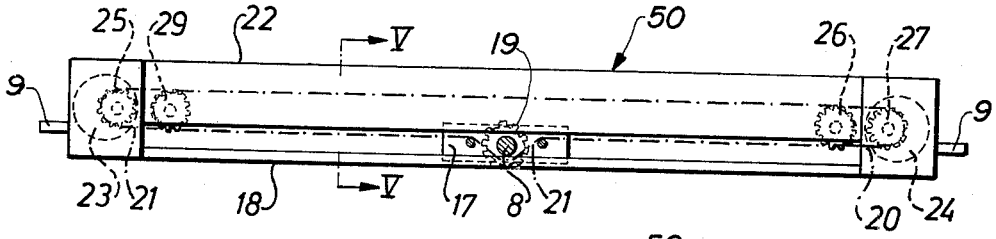
FIGS. 3 and 4 are a schematic front view and a schematic view from above, respectively, of a drive and guide means for the page-turning roller and page retainer arrangement illustrating how said arrangement is suspended by means of a carriage having one end of the page-turning roller journalled therein and how said carriage is displaceable and said roller is rotatable.
Figure 4:
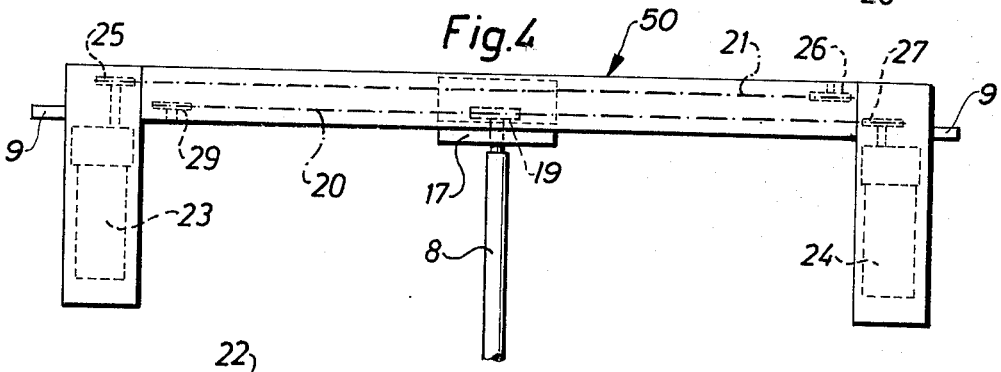
Figure 5:
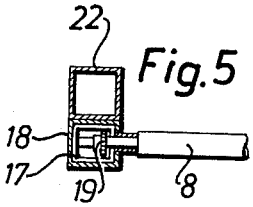
FIG. 5 is a schematic sectional view, taken along the line V-VI in FIG. 3 and further illustrating how said end of the page-turning roller is arranged and driven.

Referring now to FIGS. 3-5, in the page-turning arrangement the upper end of the page-turning roller 8 is rotatably journalled in a carriage 17. This is displaceable along a guide rail 18 of said guide and drive means 50 which has a rectangular profile. The carriage is designed as a rectangular profile slidable in the rectangular profile of the guide rail 18, the end of the page-turning roller 8 fitting into said carriage. A toothed wheel 19 is fitted at the end of the pageturning roller 8 and engages with one section of a movable chain 20 to rotate the page-turning roller 8 in one direction or the other. In order to displace the carriage 17 and thus the page-turning roller 8 in one direction or the other along the guide rail 18, one section of a movable tension chain 21 is secured to the carriage 17.

The guide rail 18 in the form of a rectangular section extends along the entire upper edge of the support 4 together with a chain tube 22 also in the form of a rectangular section, parallel with the guide rail 18 and joined to this, in which the other sections of tension chain 21 and chain 20 are located. At each end of the guide rail 18, outside the support 4, are electric motors 23 and 24 to drive the tension chain 21 for displacement of the carriage 17 and the page-turning roller 8 and to drive the chain 20 for rotation of the page-turning roller 8, respectively. Thus, tension chain 21 runs from carriage 17, around a driving wheel 25, connected by a reduction gear to the electric motor 23, at the end of the guide rail 18, a tension wheel 26 applied at the other end of the guide rail 18 and back to carriage 17. Driving chain 20 runs in a closed loop between a second driving wheel 27, which is connected by a reduction gear to the second electric motor, at the other end of guide rail 18, and a tension wheel 29 arranged at said first end of the guide rail 18, the lower section of chain 20 being in engagement with the toothed wheel 19 fixed on the end of page-turning roller 8.

The page-turning roller 8 is in the form of a rod, covered by a rubber sheath 30 on the part extending above the support 4, the diameter of the rod being the same as the diameter of the toothed wheel 19 by which the page-turning roller 8 is rotated. When carriage 17 and thus page-turning roller 8 is pulled by the tension chain 21 to one side over the support 4, the driving chain 20 remains stationary so that the toothed wheel 19 at the end of the page-turning roller 8 rolls on the driving chain 20. The pageturning roller 8 thus rolls over the pages of the book when it is pulled from one side of the book to the other.

To prevent the open book from closing by accident, particularly when the page-turner is in a vertical position on reading table, and to prevent more than the desired number of pages from being turned, the page retainers 15 and 16 are arranged in the page-turning arrangement. As sown in FIGS. 6-8, the page retainers 15 and 16 are connected by hinges 31 and are held pivotably pressed against a tubular shaft 32 and against the book by springs 36, on each side of the tubular shaft 32 attached to the page retainers 15 and 16, Said springs 36 are in contact with the side of the tubular shaft 32 which is opposite to the page retainers 15, 16. Said shaft 32 is arranged parallel to the page-turning roller 8, about 55 mm above the roller, and is attached to an arm 33 which, by means of a socket 34, is pivotably coupled to a pin 35 projecting from the carriage 17 through a slot in the guide rail 18 and carrying the journalled page-turning roller 8.

In the tubular shaft 32 an which the page retainers 15 and 16 are arranged is a rod 44 at the outer end of which is a second arm 45 pivotably connected to the outer end of the pageturning roller 8, in order to guide the shaft 32 in its movements.

When the carriage 17 is displaced by the electric motor 23 and the tension chain 21 to the righthand side of the support 4, the arm 33 is swung down towards the support by a pin 37 projecting from the chain tube 22. The arm 33 is also provided with a pin 46 which is guided by a slot-shaped guide 47, protruding from the guide rail 18, when the arm 33 is pivoted from and to its neutral position. The shaft 32 is then pressed against the side of the book by a tension spring 38 stretched between the ends of the carriage 17 and passing over a pulley 39 secured on the arm 33 below the tube 32. When the page-turning roller 8 has reached a suitable position for turning the pages, the electric motor 23 controlling the displacement of carriage 17 and roller 8 is disconnected and the electric motor 24 for the rotary movement of the roller 8 is started. The page-turning roller 8 is rotated clockwise, whereupon one page of the book is fed to the left so far that is becomes disengaged from the roller 8 and comes to rest on the upper side of the roller 8. If desired, several pages can now be turned in this position. The shaft 32 is in that case kept pressed against the pages along their attachment at the spine of the book. When the rotary movement of the page-turning roller 8 has been stopped, the carriage 17 is displaced to the left and stopped on the lefthand side of the book. The pages which have been leafed up are then turned over from the right to the lefthand side of the book. The carriage 17 may then be moved back to the righthand side of the book to turn more pages when desired. The pages of the lefthand side of the book are turned in a corresponding manner.

While leafing through the book, the righthand page retainer 16 is kept in a raised position by a guide wheel 41 rotatably journalled in a holder 40 which protrudes from the carriage 17 so that the page retainer 16 does not impede the pages being turned. The guide wheel 41 is in contact with a guide plate 42 secured to the under side of the page retainer 16 on the edge facing the carriage 17 and projecting from the page retainer in an end piece 43 a little way down on the page retainer 16.

When reading, the page-turning roller 8 is placed in the middle of the book or slightly over on the side which is not being read. The page-turning roller can be displaced and rotated by means of the electric motors 23 and 24, respectively, which are designed to run on batteries. The switches required for the various movements can be operated by means of a lever which can be moved into four different positions, for example forwards and backwards for travelling movement and to right and left for rotary movements. The switches may be placed in a special box located conventiently for use. As an alternative, switches may be used which are controlled by sucking or blowing.

What is claimed is:

1. A page-turner for turning the pages of an open publication having a spine and front and back covers, the page-turner comprising:

a frame;

a support for supporting an open publication;

first means for carrying said support on said frame;

second means for clamping the covers of such open publication on said support;

a rotatable page-turning roller having an axis extending in a first direction substantially parallel to the spine of such publication when the publication is supported by said support;

third means coupled to said frame for carrying said page-turning roller over said support and for selectively displacing said page-turning roller from one side of the support to the other in a second direction substantially perpendicular to said first direction;

fourth means for selectively rotating said page-turning roller in a desired direction of the two possible rotational directions;

fifth means for bringing said page-turning roller into contact with the pages of such open publication;

sixth means for pressing down the pages of such open publication not being turned, said sixth means including two page-retainers arranged in conjunction with the page-turning roller; and seventh means for operating said third, fourth and fifth means to sequentially bring said page-turning into engagement with a page to be turned, selectively rotate said page-turning roller so that at least said page to be turned is brought up on the page-turning roller, and displace said page-turning roller to the opposite side of the open publication, whereby said page is turned.

2. A page-turner according to claim 1, wherein said third means includes a guide rail extending in a direction perpendicular to said first direction;

means for suspending said guide rail in said frame so that said guide rail is pivotable about an axis substantially parallel to the direction of displacement of the page-turning roller;

a carriage displaceable along said guide rail; and means for rotatably suspending the pageturning roller in said carriage.

3. A page-turner according to claim 2, wherein said sixth means further include a shaft extending in parallel with the page-turning roller, a first arm for pivotably coupling said shaft to the carriage, a second arm pivotably attached to the page-turning roller and connected to said shaft, means for spring-fitting said page-retainers on the shaft, and means for pivoting said first arm and thus said shaft in a direction towards one side of the support when the carriage is displaced from a neutral position in a direction towards the other side of the support.

4. A page-turner according to claim 3, wherein fixed guide means are provided for pressing down, when the carriage is displaced, said first arm and thus said shaft and one of the page retainers towards the open publication with the help of a tension spring.

5. A page-turner according to claim 4, wherein said tension spring is secured to the ends of the carriage and runs over a pulley wheel attached to said first arm.

6. A page-turner according to claim 4, wherein the other page retainer is restrained from contact with the publication by means of a guide wheel in a holder protruding over the roller from the carriage, said guide wheel cooperating with a guide plate arranged on the under side of said page retainer.

7. A page-turner according to claim 3, wherein spring means are provided for pressing the page retainers towards the open publication, said spring means being attached to the retainers and passing over said shaft.

8. A page-turner according to claim 2, wherein said third means further include a first electric motor arranged at one end of the guide rail and first driving means coupled between said first electric motor and said carriage for transferring rotational movement generated by said first electric motor into said displacement of the carriage along the guide rail.

9. A page-turner according to claim 8, wherein said fourth means includes a second electric motor arranged at the other end of the guide rail and second driving means coupled between said second electric motor and said means for rotatably suspending the page-turning roller in the carriage for transferring rotational movement generated by said second electric motor into rotational movement of the page-turning roller.

10. A page-turner according to claim 9, wherein the second driving means includes a closed loop chain extending along the guide rail and driven by the second electric motor, and a toothed wheel secured to said means for rotatably suspending the page-turning roller in the carriage and in engagement with said closed loop chain, so that said toothed wheel can roll on said closed loop chain when the carriage is displaced along the guide rail.

11. A page-turner according to claim 1, wherein said first means include journal means for carrying the support so that the support is pivotable with respect to the frame around an axis which is substantially perpendicular to said first direction and passes approximately through the center of gravity of the support.

12. A page-turner according to claim 1, wherein the central part of the support below the page-turning roller is curved slightly downwards.

* * * * *